United States Patent [19]

Collins

[11] 3,963,533

[45] June 15, 1976

[54] LOW TEMPERATURE MAGNETIC TREATMENT OF FERROMAGNETIC MATERIALS

[75] Inventor: James D. Collins, Indianapolis, Ind.

[73] Assignee: General Motors Corporation, Detroit, Mich.

[22] Filed: Dec. 23, 1974

[21] Appl. No.: 535,978

[52] U.S. Cl. ..... 148/108; 148/125

[51] Int. Cl.[2] ..... C21D 1/04

[58] Field of Search ..... 148/108, 125, 31.55; 75/126 C

[56] References Cited

UNITED STATES PATENTS

| | | | |
|---|---|---|---|
| 2,445,294 | 7/1948 | Nelson | 148/125 |
| 2,958,618 | 11/1960 | Allen | 148/125 |
| 3,095,319 | 6/1963 | Williams | 148/108 |
| 3,188,248 | 6/1965 | Bassett | 148/108 |
| 3,360,943 | 1/1968 | Schoenfeld et al. | 148/125 |

OTHER PUBLICATIONS

Bozorth, R., Ferromagnetism, New York, 1951, pp. 117–120 and 717–720.

*Primary Examiner*—Walter R. Satterfield
*Attorney, Agent, or Firm*—George A. Grove

[57] ABSTRACT

In accordance with a preferred embodiment of this invention, ferromagnetic, polycrystalline, iron-based materials are subjected to an alternating magnetic field at low temperatures. This treatment provides improved mechanical properties and resistance to corrosive attack. It is believed that this improvement is due to a modification in the dislocation density and distribution in the material. More specifically, it is believed that this method causes a significant reduction in the dislocation density and thereby produces a more perfect crystalline lattice structure.

4 Claims, No Drawings

LOW TEMPERATURE MAGNETIC TREATMENT OF FERROMAGNETIC MATERIALS

FIELD OF THE INVENTION

This invention relates to a cryogenic-magnetic method of treating ferromagnetic materials so as to improve their mechanical and chemical properties.

BACKGROUND OF THE INVENTION

In the development of high strength iron alloys, it is generally accepted that the alloying approach has reached a plateau of about 300,000 psi tensile strength and that little improvement can be expected from further efforts in this area. Process treatments, such as annealing and ausforming, are able to produce materials having tensile strengths in the area of about 450,000 psi; however, processes of this type are restricted in application and are relatively expensive. Ultrahigh strength wire, having a tensile strength of about 500,000 psi, has been produced, but again this particular development is limited in its applications.

It is generally known that if it were not for lattice defects in the crystal structure, the strength of polycrystalline materials would be in the range of millions of psi. Theoretically, iron should not plastically deform under stresses less than about 2,000,000 psi. However, due to the crystalline defects such as dislocations, iron will plastically deform at stresses as low as 30,000 psi. To explain and hopefully control the impact of these crystalline defects many theories have been developed and are now being used in a continuing effort to produce higher strength materials.

One of the most promising theories is that based on dislocations and their control. One type of dislocation is a line defect in the crystal lattice structure. It is postulated that dislocations of unlike orientation often interact to form a more regular crystal structure. Such interactions have the net effect of annihilating dislocations.

Based on this knowledge, the effects of many processes have been theoreticaly explained in terms of their ability to modify the distribution and density of dislocations and the impact of these modifications on the physical and/or chemical properties of a polycrystalline material. Examples include work hardening which results in the accumulation of dislocations at barriers in the crystalline structure, and annealing which has the effect of reducing the number of dislocations by promoting the aforementioned combination of dislocations. Unfortunately these processes are quite expensive both in terms of the equipment required and of the energy consumed.

In the efforts which led to this invention, special attention was given to improving the life of tools made from materials such as T-15 tool steel and the corrosion resistance of steel alloys, especially stainless steel. These efforts were guided by a theory that a relatively low cost cryogenic-magnetic treatment could be used to improve these and many other properties of ferromagnetic materials.

OBJECTS OF THE INVENTION

It is an object of this invention to provide a cryogenic-magnetic method of treating iron-based alloys, containing up to, by weight, 3% carbon, 18% chromium, 15% tungsten, 6% vanadium, 6% cobalt, 2% manganese, 2% silicon and 2% nickel, so as to improve their resistance to corrosion.

It is a further object of this invention to provide a cryogenic-magnetic method of treating tool steels, such as tungsten high speed tool steels, so as to prolong the life of tools made from said steel.

It is a further object of this invention to provide a cryogenic-magnetic method of reducing the dislocation density and modifying the dislocation distribution in ferromagnetic materials so as to provide a stronger, more corrosion resistant material.

It is another object of this invention to provide a method of significantly reducing the number of dislocations in iron-based materials by subjecting the material to a cycling magnetic field at extemely low temperatures, and thereby produce a more regular crystal structure.

It is still another object of this invention to improve the mechanical and chemical properties of a ferromagnetic material by subjecting it to an alternating magnetic field at a temperature between that of liquid nitrogen and room temperature.

SUMMARY OF THE INVENTION

I have discovered that these and other objects are achieved, in a preferred embodiment, by cooling a ferromagnetic material in liquid nitrogen, at its atmospheric boiling point, and soaking the material for about ten minutes. Then the material is subjected to an alternating magnetic field having a strength of from about 50 to 150 oersteds at a frequency of about 60 cycles per second. About ten to fifteen minutes later, the liquid nitrogen is drained from the material and it is allowed to warm to room temperature under the influenece of the cycling magnetic field. The warming process requires about four hours. However, it is evident that the exposure time may be substantially reduced.

The method has utility in improving the fatigue life and/or corrosion resistance of certain high alloy steels, such as the so-called martensitic stainless steels and tungsten high speed tool steels. Such stainless steels typically contain, by weight, a small amount of carbon up to about 1.2%, 1% maximum manganese, 1% maximum silicon, 11% to 18% chromium, 0 to 2.5% nickel, and the balance generally iron. Some such commercial stainless steels contain up to 1% of other materials such as molybdenum, sulfur or selenium. The tungsten high speed tool steels are typically characterized by compositions containing, by weight, up to 1.50% carbon, about 4% chromium, 1% to 5% vanadium, 12% to 18% tungsten, and optionally 5% to 8% cobalt, the balance being iron. In addition to the above materials, as will be disclosed below, the subject process also has great potential in improving the fatigue life, corrosion resistance and other properties of iron-based ferromagnetic compositions.

It has, for example, been found that by using the subject method it is possible to extend the tool life of drills made from T-15 (AISI) tool steel by as much as 40% to 50%, and to significantly reduce the corrosive effect of synthetic sea water on 410 (AISI) stainless steel.

As is apparent from the above description, the cost of this process would be far less than that required by most other methods of treating iron and its alloys. The only major cost item would be the cryogenic equipment required to reduce the temperature of the material.

The magnetic field may be created by simply passing a current through a wire-wound coil which surrounds the workpiece.

In a specific embodiment of the process, the workpiece is continually subjected to an alternating magnetic field over a range of temperatures from that of liquid nitrogen to room temperature. However, it is apparent that the method would be effective at a specific temperature which is determinable for a given article having specific composition and thermal history. In other words, it should be possible to cool an article to a specific temperature (determinable as shown below) and apply the alternating magnetic field for a relatively short period of time. This would significantly reduce cost and facilitate the adoption of this process to high volume operations. In addition to the tool steels and stainless steels, it is also believed that this process will be effective with all ferromagnetic materials to include iron-based alloys, nickel, cobalt and even ferromagnetic ceramic materials such as the barium ferrites and the like. Ferromagnetic materials may be defined as those having a sufficient number of unpaired electrons in the subvalence shells to generate a magnetic moment of sufficient strength for there to be a spontaneous magnetic alignment of adjacent atoms.

These and other advantages to be derived from the practice of this invention will be more easily understood in view of a detailed description thereof, to include specific examples.

DETAILED DESCRIPTION OF THE INVENTION

The following three examples demonstrate the practice and effectiveness of my invention.

EXAMPLE 1

This example demonstrates the ability of the subject method to significantly extend the tool life of drills (7/32 inch dia.) made from T-15 tool steel having a nominal composition by weight of about 4% chromium, 5% vanadium, 12% tungsten, 5% cobalt, 1.5% carbon and the balance iron. The drills were used as received and, therefore, they had been heated-treated to a predetermined conditions. The cutting or tool life of a drill was evaluated by noting the number of holes ½ inch deep, the drill would cut through Inco 718 steel having a Rockwell C hardness of 44 before the drill dulled. The drill speed was 436 rpm and the feed was 0.0025 inch per minute. Dulling was defined as that point at which there is a sharp readily detectable increase in the required drilling forces.

The baselines for this evaluation were taken by measuring the tool life of three non-treated samples. These drills cut five, eight and 13 holes respectively, with an average of nine. Then a second series of three drills was evaluated after they had been subjected to liquid nitrogen temperatures without the cycling magnetic field. These drills cut eight, nine and 22 holes respectively before they dulled; the average is thirteen.

Once these baselines were established a series of three drills was then cooled to the atmospheric boiling temperature of liquid nitrogen which is 77° Kelvin (−320°F.) for approximately 10 minutes and then subjected to a 60 cycle magnetic field having a strength of about 95 oersteds. The magnetic field was generated by passing a 60 cycle alternating current of 0.7 ampere through a coil having 510 turns and a length of 4.75 cm. After 15 minutes, the liquid nitrogen was drained from the samples; however, the magnetic field was maintained until they had warmed to room temperature which required about 4 hours. The magnetic field was then turned off.

This first treatment was conducted with the direction of the magnetic field transverse to the longitudinal axis of the drills. A second cryogenic-magnetic treatment on the same samples was performed in basically the same manner, except, the magnetic field of about 88 oersteds was applied parallel to the longitudinal axis of the drills. The field was generated by passing a current of 0.7 ampere through a coil having 1530 turns and length of 15.5 cm. This series of twice treated drills was able to cut 17, 21 and 22 holes respectively in the Inco 718 steel. The average was twenty holes per drill, which represents a significant improvement over either the baseline series or the series which received the low temperature treatment.

At first reading, one could conclude that the operative mechanism in this process is the low temperature transformation from unstable austenite to martensitic steel. However, the series of drills which received both the magnetic and the cryogenic treatment performed significantly better than those drills having just the cryogenic treatment. In addition, it is generally accepted that the low temperature transformation from austenitic to martensitic steel is difficult if the steel contains vanadium and/or cobalt in total quantities of 3 percent by weight or more. It has been said that these metals are added as grain refiners and it has been impossible to gain a continuation of the transformation in these cases. This would include AISI-JAE tool steels such as T-15, M-35, M-42 and so on. This teaching may be found in a periodical, *Modern Machine Shop*, of Aug., 1970 at page 96.

EXAMPLE 2

In accordance with the cryogenic-magnetic procedure defined in Example 1, an additional six drills, made of T-15 tool steel and having a diameter of 7/32 inch were treated and their cutting life similarly evaluated.

As received, these drills cut an average of 8.5 holes each before dulling. Then, after their points were reground, the drills cut an average of an additional 9.5 holes. After a second regrinding, they cut an average of 4.2 holes. Then these drills were reground and treated by the subject cryogenic-magnetic process as described in Example 1. The drills then cut an average of 16 holes before they dulled.

This series of tests clearly demonstrates the effectiveness of the subject method in increasing cutting life of T-15 drills.

EXAMPLE 3

A test conducted on razor blades formed of type 410 stainless steel, which is a martensitic stainless steel having a nominal composition by weight of 0.15% carbon (max.), 1.0% manganese (max.), 1.0% silicon (max.), 12.5% chromium, and the balance iron, showed an improvement in their resistance to corrosion when treated in a 60 cycle magnetic field having an average field strength in the range of about 160 oersteds for a period of from two to five hours in liquid nitrogen. After treatment, the Rockwell hardness of the blades increased two points on the C scale and the blades showed considerably less corrosion than untreated blades after submersion in synthetic sea water for about three days.

While the exact mechanism or effect that this process has on the crystal structure of polycrystalline ferromagnetic materials is not thoroughly understood, it is believed that at some temperature between that of the atmospheric boiling temperature of liquid nitrogen or below, and room temperature the edge type dislocations (formed by an incomplete plane of atoms on a crystal) becomes particularly mobile and that the cycling magnetic field, in effect, provides the necessary force to both unpin and move these dislocations. Once in motion, it is believed that there is a much greater probability that the dislocations will come in contact with each other (i.e. two partial planes of atoms may line up to form a more complete plane) or some other structural feature of the crystal and interact with that feature or with other dislocations to, in effect, annihilate the dislocation. For example, it is known that dislocations of opposite signs or orientations will react with one another and the net effect of this is the elimination of both crystal defects. In addition, it is reported in the literature that dislocations will similarly react with or at magnetic domain walls.

This theory, which is described in detail below, directed the efforts which produced this invention. However, this proposed explanation is provided only for the benefit of the practioners of the subject invention and is not intended to limit its scope.

An edge dislocation may be described as an edge of an extra plane of atoms within a crystal structure. Zones of compression and of tension accompany an edge dislocation so that there is a net increase in energy along its line.

A dislocation may be moved along a slip plane, and this mechanism is considered to be prominent in any deformation process. The fact that the ductility of a polycrystalline material may be increased by processes which decrease the number of dislocations clearly supports this role of dislocations in a deformation process.

Dislocations located at the surface of a material or at grain boundaries also reduce the materials resistance to corrosion. Apparently, the high energy associated with the dislocation creates a point which is susceptible to attack by reactive agents in the atmosphere such as acids. This is supported by the fact that surface dislocations may be etched by a reactive solution for direct examination.

Based on the above understanding of the nature of dislocations, I realized that the physical strength and the resistance to corrosion of ferromagnetic polycrystalline materials may be significantly improved by reducing the density and modifying the distribution of these crystal features, and that this may be accomplished by using the interactions of dislocations of opposite signs and the interactions of dislocations with magnetic domain walls. Both of these interactions have the result of unpinning and dispersing dislocations and reducing the dislocation density. The fact that dislocations of opposite signs or orientations will react with one another and, in effect, create a more regular lattice structure, is easily visualized as two incomplete atomic planes of the opposite configuration meeting to form one uniform plane; however, at this time the interaction between dislocations and domain walls is not so easy to explain. In any event, given these interactions, the problem becomes one of increasing the rate of these interactions and the main obstacles in solving this problem appeared to be the relatively low mobility of dislocations at room temperature and above, and the difficulty of directing a force at these crystal defects.

In the practice of a more specific embodiment of the subject invention, these problems are solved by first reducing the temperature of the mateial to some point between room temperature and the atmospheric boiling temperature of liquid nitrogen, and then applying a cyclic or alternating magnetic field to the cooled material. It is apparent that at some optimum reduced temperature the mobility of the dislocations is significantly increased and the magnetic field preferentially interacts with dislocations. Thereby, it is possible to generate dislocation movement and increase the probability of interactions which annihilate dislocations. However, it is also possible that the magnetic domain walls may also be set in motion by the applied field, and this would also increase the probability of the dislocation-domain wall interaction. At this time, it is not clear whether dislocation movement or magnetic domain wall movement is the predominant mechanism which increases the probability of the dislocation annihilating interactions.

In the practice of this invention, the temperature of a ferromagnetic polycrystalline material is reduced to that point at which the dislocations move freely throughout the crystal structure. This temperature may be determined by ultrasonic attenuation, a technique which is based on internal friction. This method applies a pulse of ultrasonic frequency vibrational energy to a sample of the material and measures the amount of energy absorbed and compares that with the applied energy. The procedure should be repeated over a range of temperatures, such as from that of liquid nitrogen to room temperature, to locate a temperature range on which a greater portion of the incident energy is absorbed by the specific specimen. Peaks in the attenuation temperature curve reflect relaxation points and at low temperatures these are apparently related to dislocation movement. They may be more than one such peak as the temperature of the sample is varied from room temperature to that of liquid nitrogen and below. However, the optimum temperature would be that at which the largest peak occurs. Subsequently, at room temperature changes in the attenuation values indicate changes in the dislocation distribution and/or density. A reduction in the attenuation would indicate a reduction in the number of dislocations.

Typically, in measuring the attenuation, a sample which has two parallel sides is selected. A pulse generator, which also may act as a receiver, is mounted against and is thereby acoustically coupled to one of the parallel surfaces. A short cyclic pulse of energy is then generated and passed into the sample by the pulse generator. A portion of the energy is then reflected by the other parallel surface backwards to the pulse generator-receiver, which then detects the amount of reflected energy. From this data, the amount of energy actually absorbed by the sample is then calculated. It should be noted that care must be taken in determining the amount of energy lost but not abosrbed by the sample. For example, the energy absorbed by whatever means was used to mount and couple the pulse generator-receiver must be taken into account in this calculation. The energy absorbed by the sample may be reported in several ways such as in dicebels per unit of time, or knowing the velocity of sound in the material, decibels per unit of length. the ultrasonic technique is described in the *Canadian Journal of Physics*, Vol 34, p.

159 (1956). That description is hereby incorporated by reference. This technique is also described in the text, *Ultrasonic Methods in Solid State Physics*, by Turell, Elbaum and Chick, published by Academic Press of New York in 1969. The background discussion found in Chapter 2 is hereby incorporated by reference.

At this optimum temperature the mateial is then subjected to an alternating magnetic field having a frequency within the range of from 2.0 to 1,000 Hz or above. The optimum frequency for a specific material will produce the greatest reduction in dislocation density as measured by the afore-mentioned ultrasonic technique. It is believed that dislocations will respond to a very broad range of frequencies (e.g., from 1 Hz to several Mega Hz) because of their widely varying lengths. However, if an extremely high frequency is used the dislocations will merely vibrate instead of moving an appreciable distance. This alone, would not significantly increase the probability of the desired interactions which reduce dislocation density. It is also to be noted that the temperature of some relaxation peaks (e.g., the Bordoni peaks) are somewhat frequency dependent while most others are not.

By using these methods to select the optimum magnetic field frequency and temperature of application, the maximum amount of applied energy will be transferred directly to the dislocations and/or domain walls and thereby cause the greatest dislocation and/or domain wall movement and the largest probability for the desired dislocation annihilating interactions. When this embodiment of my invention can be employed, it is preferable to applying the alternating magnetic field energy to a work piece over a wide range of temperatures including temperatures at which the radiation has less effect on crystal defects.

The strength of the applied magnetic field should be controlled so that the material maintains distinct magnetic domains. If too strong a field is used, the material will become saturated and some magnetic domains will grow in size at th expense of others and the net area of domain walls will be greatly reduced. Thus, there would be less domain walls to interact with the moving dislocations, and the number of these dislocation annihilating interactions would be correspondingly reduced. On the other hand, if too weak a magnetic field is used, the net displacement of the dislocations and/or domain walls will not be great enough to significantly increase the probability of the desired interactions. The preferred strength for iron and its alloys is between 50 and 150 oersteds.

Example 4, which follows, describes a series of ultrasonic attenuation measurements taken at a frequency of 5 Megahertz on a sample of T-15 tool steel after various cryogenic-magnetic treatments. In this case the attenuation measurements are made to determine the effect of various treatments on the same tool steel specimens. The attenuation of a crystalline material is indicative of the number of crystal features which absorb energy at that frequency and temperature. At these conditions, 5 Megahertz and room temperature, dislocations will absorb vibrational energy. Therefore, the attenuation readings indicate the number of dislocations in the material.

EXAMPLE 4

In this example a small bar of hardened and tempered T-15 tool steel was twice subjected to a steady magnetic field and then thrice subjected to a 60-cycle per second magnetic field at the temperature of liquid nitrogen in accordance with the procedures described in Example 1. In each case, the field strength was about 90 oersteds. The room temperature ultrasonic attenuation at 5 Megahertz was monitored after each magnetic treatment.

Table 1

| Treatment Conditions | Attenuation (db/sec) |
|---|---|
| 1. No treatment (as received) | 0.62 |
| 2. DC Magnetic Field (transverse*) | 0.74 |
| 3. Repeat of 2 | 0.90 |
| 4. AC Magnetic Field (longitudinal) | 0.49 |
| 5. Repeat of 4 (transverse) | 0.51 |
| 6. Repeat of 4 (longitudinal) | 0.48 |

*field direction with respect to axis of specimen.

Attenuation recorded at the completion of the first AC (alternating magnetic field) treatment shows a significant decrease in attenuation as compared to the as received sample, and an even greater decrease when compared to the sample after it was treated with the constant (DC) magnetic field. This reduction is apparently caused by a dislocation dispersal and the annihilation of dislocations from their interaction with magnetic domain walls. There was no change in hardness during this series of tests which indicate that the operative mechanism was not the transformation of unstable austenite to martensite.

Based on the above theory, the subject process should be effective on any material which exhibits ferromagnetic properties at some specific temperature. This would include non-ferrous materials which have the necessary ferromagnetic properties. In addition to ferromagnetism, the materials must also have the property that at some temperature the dislocations and/or magnetic domain walls move relatively freely under the influence of an imposed magnetic field.

While the invention has been described in terms of specific embodiments, it will be appreciated that other forms thereof could be adapted by one skilled in the art. Therefore, the scope of this invention is not to be limited to the specific embodiments disclosed.

What is claimed is:

1. A cryogenic-magnetic method of reducing dislocation density and altering dislocation distribution in an article formed from a polycrystalline ferromagnetic iron based material so as to provide improved mechanical properties, and resistance to corrosion, said method comprising:

a. reducing the temperature of said article to that of a relaxation point detectable by ultrasonic attenuation techniques;

b. imposing an alternating magnetic field on said article, said field having a maximum strength in the range of from about 50 to about 150 oersteds, and alternating at a frequency in the range of from about 2.0 to about 1,000 hertz until the ultrasonic attenuation at 5 Megahertz is reduced by from about 10% to about 50%;

c. removing said magnetic field; and d. allowing said article to warm to room temperature.

2. A cryogenic-magnetic method of treating an article formed from a polycrystalline ferromagnetic iron-based material, and heat-treated to a predetermined condition, said method provides improved mechanical properties and resistance to corrosion, said method comprising:

a. reducing the temperature of said article to the atmospheric boiling temperature of liquid nitrogen;
b. imposing an alternating magnetic field on said article, said field having a maximum strength in the range of from about 50 to about 150 oersteds, and alternating at a frequency in the range of from about 2 to about 1000 hertz;
c. allowing said article to warm to room temperature while still subject to said field; and
d. removing said field.

3. A cryogenic-magnetic method of treating a tool formed from T-15 tool steel and heat treated to a predetermined condition, so as to provide improved tool life, said method comprising:

a. reducing the temperature of said tool to the atmospheric boiling temperature of liquid nitrogen;
b. imposing an alternating magnetic field on said tool, said field having a maximum strength in the range of from about 50 to about 150 oersteds, and alternating at a frequency in the range of from about 2 to about 1000 hertz;
c. allowing said tool to warm to room temperature while still subject to said magnetic field; and
d. removing said field.

4. A cryogenic-magnetic method of treating an article formed of an alloy steel taken from the group consisting of martensitic stainless steels and high speed tungsten tool steels, said method comprising:

a. reducing the temperature of said article to the atmospheric boiling temperature of liquid nitrogen;
b. imposing an alternating magnetic field on said article, said field having a maximum strength in the range of from about 50 to about 150 oersteds, and alternating at a frequency in the range of from about 2 to about 1000 hertz;
c. allowing said article to warm to room temperature while still subject to said magnetic field; and
d. removing said field.

* * * * *